US009214740B2

(12) United States Patent
Amano et al.

(10) Patent No.: US 9,214,740 B2
(45) Date of Patent: Dec. 15, 2015

(54) RADIAL LINE SLOT ARRAY ANTENNA

(75) Inventors: Osamu Amano, Tokyo (JP); Makoto Ando, Tokyo (JP)

(73) Assignees: NEC Space Technologies, Ltd., Tokyo (JP); TOKYO INSTITUTE OF TECHNOLOGY, Tokyo (JP)

( * ) Notice: Subject to any disclaimer, the term of this patent is extended or adjusted under 35 U.S.C. 154(b) by 121 days.

(21) Appl. No.: 13/394,052

(22) PCT Filed: Sep. 1, 2010

(86) PCT No.: PCT/JP2010/065352

§ 371 (c)(1), (2), (4) Date: Mar. 2, 2012

(87) PCT Pub. No.: WO2011/027898

PCT Pub. Date: Mar. 10, 2011

(65) Prior Publication Data

US 2012/0162039 A1 Jun. 28, 2012

(30) Foreign Application Priority Data

Sep. 4, 2009 (JP) ..... 2009-204626

(51) Int. Cl.

*H01Q 13/10* (2006.01)
*H01Q 21/06* (2006.01)
*H01Q 21/00* (2006.01)
(Continued)

(52) U.S. Cl.

CPC ..... *H01Q 21/064* (2013.01); *H01Q 21/0012* (2013.01); *H01Q 21/20* (2013.01); *H01Q 21/22* (2013.01); *H01Q 21/26* (2013.01)

(58) Field of Classification Search

CPC ..... H01Q 13/22; H01Q 21/20; H01Q 21/24; H01Q 1/38; H01Q 5/00; H01Q 13/10; H01Q 11/10; H01Q 21/005; H01Q 21/0056
USPC ..... 343/767, 770, 771
See application file for complete search history.

(56) References Cited

U.S. PATENT DOCUMENTS 5,175,561 A 12/1992 Goto
5,239,311 A * 8/1993 Arimura et al. ..... 343/771
(Continued)

FOREIGN PATENT DOCUMENTS

DE 4013952 A1 11/1990
DE 4026432 A1 2/1991
(Continued)

OTHER PUBLICATIONS

Extended European Search Report, dated Feb. 8, 2013, issued by the European Patent Office in counterpart European Patent Application No. 10813844.7.
(Continued)

*Primary Examiner* — Dameon E Levi
*Assistant Examiner* — Collin Dawkins
(74) *Attorney, Agent, or Firm* — Sughrue Mion, PLLC

(57) ABSTRACT

A radial line slot array antenna has a slotted conductor plate in which a plurality of slots are formed and arranged in a spiral. The plurality of slots are arranged in the slotted conductor plate such that the arrangement distance in a radial direction between the slots varies gradually between a first portion determined based on a first frequency and a second portion determined based on a second frequency that is different from the first frequency.

8 Claims, 2 Drawing Sheets

(51) Int. Cl.

| | |
|---|---|
| ***H01Q 21/20*** | (2006.01) |
| ***H01Q 21/22*** | (2006.01) |
| ***H01Q 21/26*** | (2006.01) |

(56) References Cited

U.S. PATENT DOCUMENTS

| | | | | |
|---|---|---|---|---|
| 5,661,498 | A * | 8/1997 | Goto et al. | 343/771 |
| 6,124,833 | A * | 9/2000 | Bialkowski et al. | 343/770 |
| 6,211,839 | B1 * | 4/2001 | Campbell | 343/792.5 |
| 2005/0225497 | A1 * | 10/2005 | Christensen et al. | 343/893 |

FOREIGN PATENT DOCUMENTS

| | | | |
|---|---|---|---|
| JP | 4-43705 | A | 2/1992 |
| JP | 4213203 | A | 8/1992 |
| JP | 5-67918 | A | 3/1993 |
| JP | 5-83029 | A | 4/1993 |
| JP | 5-110335 | A | 4/1993 |
| JP | 5-283931 | A | 10/1993 |
| JP | 6-314925 | A | 11/1994 |
| JP | 2002-217640 | A | 8/2002 |

OTHER PUBLICATIONS

Office Action with Search Report dated Nov. 1, 2013, issued by the State Intellectual Property Office of the P.R.C. in corresponding Chinese Application No. 201080039318.0.

Office Action dated Mar. 19, 2014, issued by the Japan Patent Office in corresponding Japanese Application No. 2009-204626.

* cited by examiner

RADIAL LINE SLOT ARRAY ANTENNA

CROSS REFERENCE TO RELATED APPLICATIONS

This application is a National Stage of International Application No. PCT/JP2010/065352 filed on Sep. 1, 2010, which claims priority from Japanese Patent Application No. 2009-204626, filed on Sep. 4, 2009, the contents of all of which are incorporated herein by reference in their entirety.

TECHNICAL FIELD

This invention relates to a radial line slot array antenna, and in particular to an arrangement of a plurality of slots formed in a slotted conductor plate.

BACKGROUND ART

In a related-art radial line slot array antenna, a slot pattern is provided such that desired radio waves can be emitted. One of these types of antennas is described, for example, in Japanese Laid-Open Patent Publication No. H05-67918 (Patent Literature 1).

In another related-art radial line slot array antenna, a plurality of slots are arranged in concentric circles which are spaced apart in a radial direction by distances corresponding to a plurality of frequency bands, respectively. One of these types of antennas is described in Japanese Laid-Open Patent Publication No. H05-83029 (Patent Literature 2).

In another related-art radial line slot array antenna, a plurality of slots formed along circular or semi-circular arcs such that the distance between the slots becomes sequentially smaller along the circumferential direction in order to make the radiated power uniform. One of these types of antennas is described in Japanese Laid-Open Patent Publication No. H05-283931(Patent Literature 3).

DISCLOSURE OF THE INVENTION

A radial line slot array antenna in general has a plurality of slots arranged to fit a specific frequency (central frequency of used frequency band), and hence has a problem that the usable frequency band is narrow.

The radial line slot array antenna described in Patent Literature 2 is intended to solve the aforementioned problem. However, in the case of this antenna, the number of concentric circles on which the slots are arranged (the number of sections into which the used frequency band is divided) must be increased in order to obtain more uniform electrical characteristics such as gain and axial ratio. In addition, the slots on adjacent concentric circles need be arranged so as not to overlap with each other. These restrictions cause a problem for the antenna of Patent Literature 2 that the configuration is complicated and the production is difficult.

Therefore, an object of this invention is to provide a radial line slot array antenna having a simple configuration and yet capable of providing desired electrical characteristics such as gain and axial ratio which are uniform over a wide frequency range.

An aspect of this invention provides a radial line slot array antenna having a slotted conductor plate in which a plurality of slots are formed and arranged in a spiral. The radial line slot array antenna is characterized in that the slots are arranged such that the arrangement distance in a radial direction between the slots changes gradually between a first portion determined based on a first frequency and a second portion determined based on a second frequency that is different from the first frequency.

In the inventive radial line slot array antenna, the arrangement distance in a radial direction between the slots changes gradually between the first portion determined based on the first frequency and the second portion determined based on the second frequency. This realizes a radial line slot array antenna having a simple configuration and yet capable of providing a uniform frequency characteristic over a wide frequency band.

BEST MODE FOR CARRYING OUT THE INVENTION

Exemplary embodiments of this invention will be described with reference to the drawings. Since a radial line slot array antenna according to this invention has a basic configuration that is the same as that of the conventional antennas, only the slotted conductor plate constituting a difference from the conventional radial line slot array antennas will be described. The basic configuration of the radial line slot array antennas is described in Patent Literatures 1, 2 and 3, for example.

Figure 1:
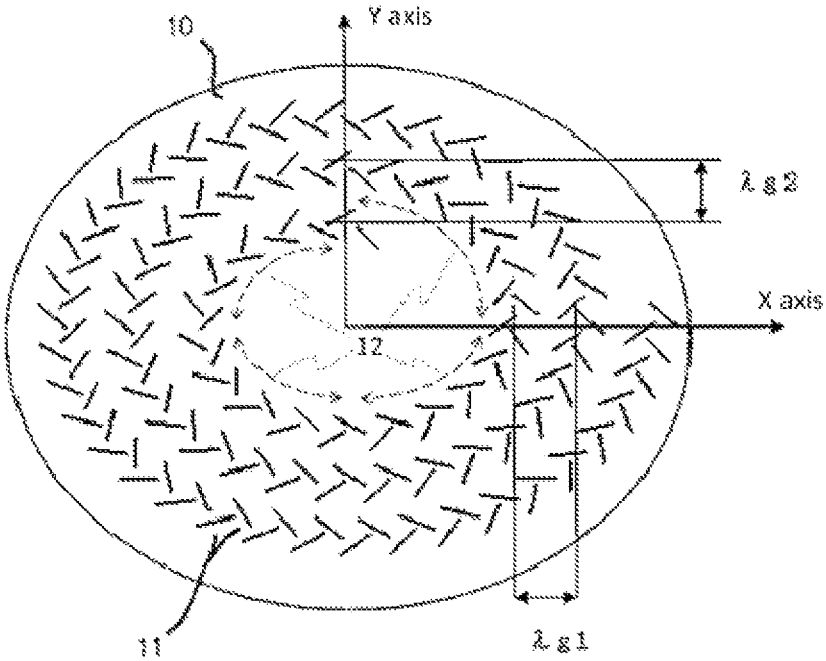
FIG. 1 is a plan view of a slotted conductor plate for use in a radial line slot array antenna according to an embodiment of the invention.

FIG. 1 is a plan view illustrating a slotted conductor plate for use in a radial line slot array antenna according to an embodiment of this invention.

The slotted conductor plate 10 shown here is a thin plate having an elliptical planar shape and made of a metal such as copper. The slotted conductor plate 10 has a plurality of slots 11 arranged in a spiral so that circular polarized waves can be transmitted and received. The slots 11 are formed by etching or the like so as to pass from one surface (top surface) of the slotted conductor plate 10 to the other surface (rear surface) thereof. These slots 11 include two different types of slots. When it is assumed that the positions where the plurality of slots 11 are arranged are determined based on a spiral line, some of the slots are positioned on the inner side of the spiral line while the other slots are positioned on the outer side of the spiral line. These two different types of slots 11 both have a rectangular shape. Each pair of the slots 11 belong to the two different types are arranged to form a predetermined angle with each other and at a distance from each other. The slots 11 belonging to each of these two types are arranged at a predetermined angle with respect to the spiral line. The size of each slot can be adjusted according to the position where that is formed (distance from the center). For example, the size can be increased as the position of the slot becomes further from the center.

When the major axis of the slotted conductor plate 10 is defined as the X axis (first radial direction) and the minor axis is defined as the Y axis (second radial direction), an arrangement distance between the slots 11 in a radial direction (spacing of the spiral line) is determined based on a frequency f1 as for the X axis (or a first portion on the X axis), whereas it is determined based on a frequency f2 (>f1) as for the Y axis (or a second portion on the Y axis). Specifically, when a guide wavelength of electromagnetic waves with the frequency f1 is denoted by λg1, the distance between the slot pairs arranged on the X axis is determined to be λg1. When a guide wavelength of electromagnetic waves with the frequency f2 is denoted by λg2, the distance between the slot pairs arranged on the Y axis is determined to be λg2 (<λ1). However, these arrangement distances are determined without taking into consideration the effect (phase shift), caused by the formation of the slots, on transmitted waves propagated through the interior. If this effect is taken into consideration, the arrangement distances will assume values deviating from λg1 and λg2.

In order that the arrangement distance between the slots 11 in a radial direction gradually varies along a circumferential direction, a plurality of slots are formed and arranged between the adjacent X axis and Y axis (portions corresponding to respective quadrants, or interpolation portions 12) so as to interpolate the slots 11 arranged on the X axis and the slots 11 arranged on the Y axis. This means that a plurality of slots are formed at predetermined intervals on the assumed spiral line.

According to the configuration described above, the arrangement of the slots in the X-axis direction is optimized at the frequency f1 while the arrangement of the slots in the Y-axis direction is optimized at the frequency f2, and further the interpolation is performed between them. This makes it possible to obtain a substantially uniform antenna gain (amplitude) at least in the range from the frequency f1 to the frequency f2. Although it is assumed in this embodiment that the major axis and the minor axis are axes orthogonal to each other (X axis and Y axis), the major axis and the minor axis need not necessarily be orthogonal to each other.

The slotted conductor plate according to this embodiment could seem to be the same as the slotted conductor plate described in Patent Literature 1. However, the arrangement of the slots in the slotted conductor plate according to this embodiment of the invention is determined based on used frequencies, whereas the slot pattern in the slotted conductor plate according to Patent Literature 1 is determined according to a dielectric constant of a dielectric having an anisotropic structure. Since in this embodiment it is assumed to use a dielectric having an isotropic structure, the slotted conductor plate is formed in an elliptical shape as shown in FIG. 1. However, when an anisotropic dielectric is used, the slotted conductor plate is formed in a shape different from that in FIG. 1, a circular shape, for example.

Figure 2:
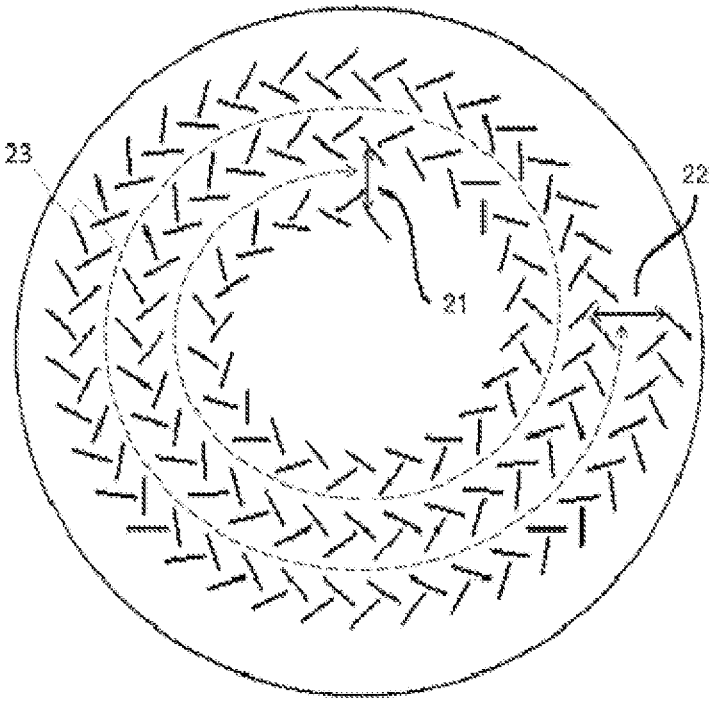
FIG. 2 is a plan view of a slotted conductor plate for use in a radial line slot array antenna according to another embodiment of the invention.

While the invention has been described with reference to an exemplary embodiment thereof, the invention is not limited to this embodiment. It should be understood by those skilled in the art that the configuration and details of the invention can be modified or altered in various manners within the scope of the invention. For example, in the aforementioned embodiment, the first portion is defined as a portion on the X axis and the second portion is defined as a portion on the Y axis. However, as shown in FIG. 2, the first portion may be defined as a portion 21 corresponding to the slots located at one end of the row of the slots arranged in a spiral, and the second portion may be defined as a portion 22 corresponding to the slots located at the other end of the row. In this case, the distance between the slot located at one end of the row of the slots and the slot adjacent to this slot in a radial direction (the adjacent slot located on the outer peripheral side thereof) (the spacing of the spiral line) is determined based on the frequency f1 (or f2), and the distance between the slot located at the other end of the row and the slot adjacent to this slot in a radial direction (the slot located on the inner turn adjacent thereto) is determined based on the frequency f2 (or f1). Then, a plurality of slots are formed and arranged as an interpolation portion 23 between the slots at the opposite ends such that the arrangement distance in the radial direction changes gradually along the peripheral direction from the value determined based on the frequency f1 to the value determined based on the frequency f2.

This application is based upon and claims the benefit of priority from Japanese Patent Application No. 2009-204626 filed Sep. 4, 2009, the disclosure of which is incorporated herein in its entirety by reference.

The invention claimed is:

1. A radial line slot array antenna comprising:

a slotted conductor plate in which a plurality of slots are formed and arranged in a spiral, the spiral comprising a first portion along which a first plurality of slots of the plurality of slots are arranged and a second portion along which a second plurality of slots of the plurality of slots, wherein the first plurality of slots in the first portion are arranged with a first arrangement distance between the first plurality of slots in a radial direction, the first arrangement distance corresponding to a first spacing between a line of the spiral at the first portion, wherein the second plurality of slots in the second portion are arranged with a second arrangement distance between the second plurality of slots in a radial direction, the second arrangement distance corresponding to a second spacing between the line of the spiral at the second portion, the first arrangement distance and the second arrangement distance being different from each other, wherein the first arrangement distance is selected to maximize the antenna gain at a first frequency of a used frequency band, and wherein the second arrangement distance is selected to maximize the antenna gain at a second frequency of the used frequency band that is different from the first frequency.

2. The radial line slot array antenna according to claim 1, wherein the first portion is a portion along a first radial direction, and the second portion is a portion along a second radial direction that is different from the first radial direction.

3. The radial line slot array antenna according to claim 2, wherein the first radial direction and the second radial direction are orthogonal to each other.

4. The radial line slot array antenna according to claim 1, wherein the first portion is a portion corresponding to the end of an inner turn of a row formed by the plurality of slots, and the second portion is a portion corresponding to the end of an outer turn of the row of the slots.

5. The radial line slot array antenna according to claim 2, having an interpolation portion between the first portion and the second portion, the interpolation portion provided with one or more slots arranged such that an arrangement distance of the plurality of slots in a radial direction changes gradually between the first arrangement distance of the first portion and the second arrangement distance of the second portion.

6. The radial line slot array antenna according to claim 1, wherein the plurality of the slots are formed and arranged so as to transmit and receive circular polarized waves.

7. The radial line slot array antenna according to claim 3, having an interpolation portion between the first portion and the second portion, the interpolation portion containing one or more slots arranged such that an arrangement distance of the plurality of slots in a radial direction changes gradually between the first arrangement distance of the first portion and the second arrangement distance of the second portion.

8. The radial line slot array antenna according to claim 4, having an interpolation portion between the first portion and the second portion, the interpolation portion containing one or more slots arranged such that an arrangement distance of the plurality of slots in a radial direction changes gradually between the first arrangement distance of the first portion and the second arrangement distance of the second portion.

* * * * *